US007971868B2

(12) United States Patent
Matsushima et al.

(10) Patent No.: US 7,971,868 B2
(45) Date of Patent: Jul. 5, 2011

(54) SHEET FEEDING APPARATUS AND IMAGE FORMING APPARATUS WITH LIFTER MECHANISM

(75) Inventors: Akira Matsushima, Suntou-gun (JP); Minoru Kawanishi, Yokohama (JP); Yasuhiro Uchida, Yokohama (JP); Eiji Wakiyama, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/202,490

(22) Filed: Sep. 2, 2008

(65) Prior Publication Data

US 2009/0066009 A1 Mar. 12, 2009

(30) Foreign Application Priority Data

Sep. 7, 2007 (JP) ..... 2007-232260

(51) Int. Cl.
*B65H 3/06* (2006.01)

(52) U.S. Cl. ..... 271/118; 271/117; 271/126; 271/127; 271/164

(58) Field of Classification Search ..... 271/117, 271/118, 126, 127, 152–156
See application file for complete search history.

(56) References Cited

U.S. PATENT DOCUMENTS

| | | | | |
|---|---|---|---|---|
| 3,981,497 | A * | 9/1976 | Feinstein et al. | 271/126 |
| 5,678,814 | A * | 10/1997 | Yokoyama et al. | 271/9.05 |
| 5,700,006 | A | 12/1997 | Sekiya et al. | 271/241 |
| 5,765,826 | A | 6/1998 | Isoda et al. | 271/162 |
| 5,775,686 | A * | 7/1998 | Miyake | 271/127 |
| 5,893,555 | A * | 4/1999 | Kawada et al. | 271/117 |
| 6,244,588 | B1 * | 6/2001 | Tsubakimoto et al. | 271/164 |
| 6,527,267 | B1 | 3/2003 | Kuwata et al. | 271/9.13 |
| 6,643,480 | B2 | 11/2003 | Kuwata et al. | 399/107 |
| 6,830,245 | B2 | 12/2004 | Matsushima et al. | 271/171 |
| 6,871,848 | B2 | 3/2005 | Matsushima et al. | 271/171 |
| 6,994,341 | B2 * | 2/2006 | Aoki et al. | 271/117 |
| 7,029,006 | B2 | 4/2006 | Izumi et al. | 271/145 |
| 7,130,548 | B2 | 10/2006 | Uchida | 399/12 |
| 7,597,313 | B2 * | 10/2009 | Dan | 271/10.03 |
| 7,802,784 | B2 * | 9/2010 | Yamamoto | 271/117 |
| 2008/0180654 | A1 | 7/2008 | Bathiche et al. | 356/51 |

FOREIGN PATENT DOCUMENTS

| | | | |
|---|---|---|---|
| JP | 01317923 | A * | 12/1989 |
| JP | 2004-43144 | | 2/2004 |

* cited by examiner

*Primary Examiner* — Jeremy Severson
(74) *Attorney, Agent, or Firm* — Fitzpatrick, Cella, Harper & Scinto

(57) ABSTRACT

A sheet feeding apparatus includes a middle plate, a lifter mechanism, and a sheet-feed roller. The sheet-feed roller can move to a first position retracted from the sheet, a second position lower than the first position for feeding the sheet, and a third position lower than the second position. The sheet feeding apparatus has a position control mode in which when a sheet is fed, the sheet-feed roller is moved from the first position to the third position and stopped there, the middle plate is moved toward the sheet-feed roller by the lifter mechanism, the sheet stacked on the middle plate is brought into abutment against the sheet-feed roller, the middle plate is moved until a position detection sensor outputs the detection signal that the sheet-feed roller is in the second position, and a height of the sheet is controlled.

16 Claims, 11 Drawing Sheets

SHEET FEEDING APPARATUS AND IMAGE FORMING APPARATUS WITH LIFTER MECHANISM

BACKGROUND OF THE INVENTION

1. Field of the Invention

The present invention relates to a sheet feeding apparatus which feeds a sheet such as an original or a recording sheet to an image forming apparatus such as a printer, a facsimile machine or a copier, and to an image forming apparatus including the sheet feeding apparatus.

2. Description of the Related Art

Some conventional image forming apparatuses such as printers, copiers and facsimile machines have a feeding apparatus which feeds a sheet to the image forming apparatus. In the sheet feeding apparatus, sheets are stacked on a sheet stacking member (middle plate) which is vertically movably provided in a sheet storage portion, the sheets are lifted to a feeding position, and then the sheets are sent out toward the image forming portion by a sheet feeding member.

In such a sheet feeding apparatus, when sheets are to be stacked on a sheet storage portion for adding or exchanging sheets, the sheet storage portion can be pulled out from the sheet feeding apparatus. In association with the pulling-out operation of the sheet storage portion, the sheet stacking member can be lowered to a predetermined sheet stacking position.

The sheet feeding apparatus connected to a printer, for example, is provided with a sheet upper surface detection sensor which detects a height position of the top sheet stacked on the sheet stacking member. Based on the detection information of the sheet upper surface detection sensor, the sheet stacking member moves. With this, the height position of the top sheet is always maintained at a given height.

As the sheet feeding member, if a sheet-feed signal is sent from the image forming apparatus, the sheet-feed roller abuts against the top sheet and rotates, and the top sheet is fed to a next pair of separation rollers.

The pair of separation rollers separately feeds sheets sent by the sheet-feed roller one-sheet at a time, and sends out the sheets to the image forming apparatus. At that time, if the sheet-feed roller sends out the sheet to the pair of separation rollers, the sheet feed roller retracts above the sheet so that the sheet feed roller does not hinder when the pair of separation rollers separate the sheets from each other and does not abut against the sheet. Whenever the sheet-feed signal is sent from the image forming apparatus, the above operation is repeated and sheets are sent out to the image forming apparatus sheet by sheet.

FIGS. 9 and 10 show a conventional elevating mechanism of such a sheet-feed roller 1053. A sheet Sa supported by a middle plate 1101 as a sheet stacking member incorporated in a sheet cassette is sent out by a sheet-feed roller 1053. The sheet-feed roller 1053 is rotatably held by a turning end of a roller holder 1110 which is turnably mounted on a shaft 1109 of the feed roller 1054, and the sheet-feed roller 1053 can move vertically.

The roller holder 1110 is provided with a sensor flag 1110*a*. The sensor flag 1110*a* moves to a position where sensor light of the optical sensor 1111 can be blocked. A position where light projection/light shield of the optical sensor 1111 is switched by the sensor flag 1110*a* is a position at which an appropriate sheet feed pressure is applied to an upper surface of a sheet by the sheet-feed roller 1053 when sheets are fed (position shown in FIG. 9B).

The middle plate 1101 supports a sheet Sa and can be vertically moved by a push-up plate 1102. As shown in FIG. 9C, if the amount of sheets is reduced by feeding sheets and light of the optical sensor 1111 is not blocked by the sensor flag 1110*a* (light projection state), the middle plate 1101 moves upward. If the optical sensor 1111 is switched from the light projection state by the sensor flag 1110*a*, the upward movement of the middle plate 1101 is stopped based on this detection. With this, whenever a sheet S stored in the sheet cassette is sent out and the height of the upper surface of the sheets becomes lower than a predetermined level, the middle plate 1101 is moved upward so that the upper surface position of the sheets can be maintained at a predetermined height level where appropriate sheet feeding pressure is applied.

In the conventional sheet feeding apparatus, after a sheet is sent out, the sheet-feed roller 1053 is moved upward and separated from the upper surface of a sheet. This is the same also when the last sheet in the sheet cassette is sent out. Therefore, if the last sheet is sent out, the sheet-feed roller 1053 is moved to its original position above the sheet cassette shown in FIG. 9A.

The sheet-feed roller 1053 is located at the initial position also when sheets are added and the sheet cassette is attached to the apparatus body. When the sheet-feed roller 1053 is in the initial position, the light of the optical sensor 1111 is blocked by the sensor flag 1110*a*.

Since the light of the optical sensor 1111 already is blocked when the sheet cassette is to be attached, even if the upper surface of a sheet does not reach the predetermined height range at which an appropriate sheet feeding pressure is applied, a control section determines that the apparatus is in a state where a sheet can be fed. Therefore, when the sheet cassette is attached, the middle plate 1101 can not be moved upward or an upper surface of a sheet can not be moved to the predetermined height range at which the appropriate sheet feeding pressure is applied.

In this case, the sheet feeding operation is started even though a sheet S does not reach a position where a sheet can be fed ("sheet-feeding position", hereinafter). As a result, there is a fear that a sheet-feeding failure may be caused, or the middle plate 1101 may be brought higher than necessary depending upon control, and inconvenience such as deformation of parts may be caused.

As a method for solving such a problem, there is a conventional technique as shown in FIGS. 10 and 11 (Japanese Patent Application Laid-open No. 2004-043144). According to this technique, there is provided a cam member 1112 which lowers a sheet-feed roller 1053 when a sheet is to be fed, and which brings up the sheet-feed roller 1053 to an initial position above a sheet on standby. When a sheet cassette 1052 is inserted, the cam member 1112 is mechanically rotated through a turning member 1001 in which an abutting member 1052*a* disposed in the sheet cassette 1052 is disposed in a body, and the lift up of the sheet-feed roller 1053 is released as shown in FIG. 11B. With this, since the sheet-feed roller 1053 is lowered when the sheet cassette 1052 is inserted, a detector can detect an upper surface of a sheet.

However, according to the technique in which the lift up of the sheet-feed roller 1053 is mechanically released when the sheet cassette is inserted, since the lift-up mechanism is required, the cost is increased. The mechanism is constituted such that it works when the cam member 1112 is in a standby position. Therefore, when the cam member 1112 is not in the standby position due to a jam, the lift up of the sheet-feed roller 1053 can not be released even if the sheet cassette 1052 is inserted and as a result, there is a possibility that the detector can not detect.

SUMMARY OF THE INVENTION

The present invention provides a sheet feeding apparatus capable of reliably feeding a sheet with an inexpensive structure, and provides an image forming apparatus including said sheet feeding apparatus.

The sheet feeding apparatus of the present invention has the following elements.

A sheet feeding apparatus comprising a sheet stacking member on which a sheet can be stacked, a lifter mechanism which configured to lift the sheet stacking member towards a sheet feeding member, a sheet feeding member which is moveable, and which is configured to engage with a sheet stacked on the sheet stacking member to feed the sheet, and a detector, operable to output a detection signal based on a position of the sheet feeding member, in which the sheet stacking member is adapted to be lifted by the lifter mechanism based on detection of the detector, such that an upper surface of the topmost stacked sheet is moved to a sheet-feeding position, wherein in a sheet feeding standby state the sheet feeding member is positioned at a standby position above the sheet feeding position, when the sheet feeding operation of the sheet is started from the sheet feeding standby state, the sheet feeding member is lowered from the standby position towards the sheet feeding member, the sheet stacking member is lifted by the lifter mechanism based on detection of the detector, and the upper surface of the sheet stacked on the sheet stacking member is moved to the sheet-feeding position.

A sheet feeding apparatus for feeding a sheet stacked on a sheet stacking member using a sheet feeding member, comprising a sheet stacking member on which a sheet can be stacked, a lifter mechanism which is adapted to lift the sheet stacking member, a sheet feeding member which is configured to feed a sheet stacked on the sheet stacking member, and which is operable to move to a first position retracted from the sheet stacked on the sheet stacking member, a second position lower than the first position for feeding the sheet, and a third position lower than the second position, and a detector operable to output a detection signal based on a position of the sheet feeding member, wherein the sheet feeding apparatus has a position control mode in which when a sheet is fed, the sheet feeding member is moved from the first position to the third position and stopped there, the sheet stacking member is moved by the lifter mechanism toward the sheet feeding member, the sheet stacked on the sheet stacking member is brought into engagement with the sheet feeding member, and the sheet stacking member is moved until the detector outputs the detection signal that the sheet stacking member is in the second position.

Further features of the present invention will become apparent from the following description of exemplary embodiments with reference to the attached drawings.

DESCRIPTION OF THE EMBODIMENTS

An image forming apparatus having a sheet feeding apparatus according to an embodiment of the present invention will now be described with reference to the drawings.

In this embodiment, a laser beam printer is indicated as the image forming apparatus, and the embodiment will be explained using a sheet feeding apparatus connected to the printer.

[Image Forming Apparatus]

Figure 1:
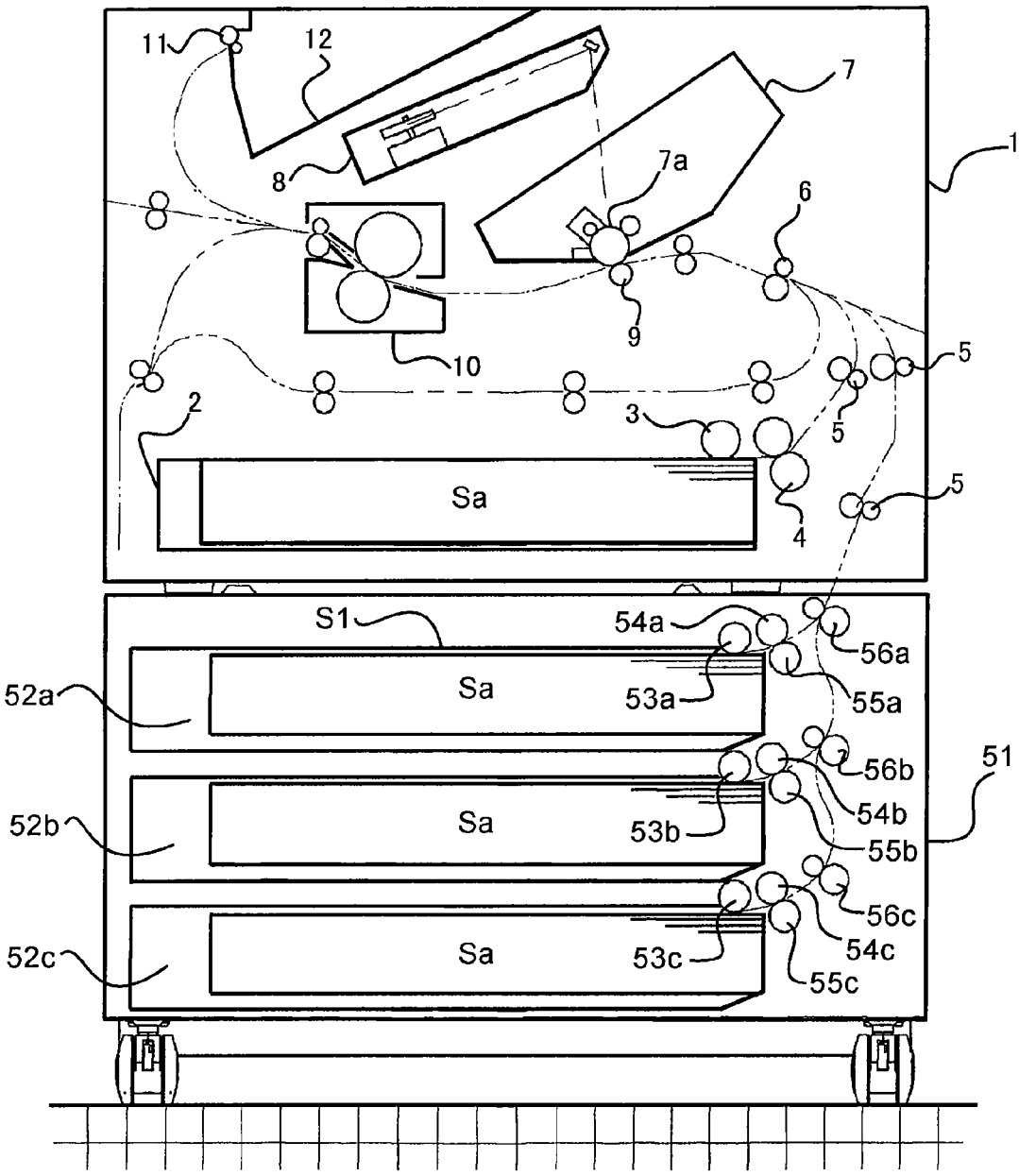
FIG. 1 is a schematic sectional view illustrating the entire structure of a printer to which a sheet feeding apparatus according to the present invention is attached.
Figure 2:
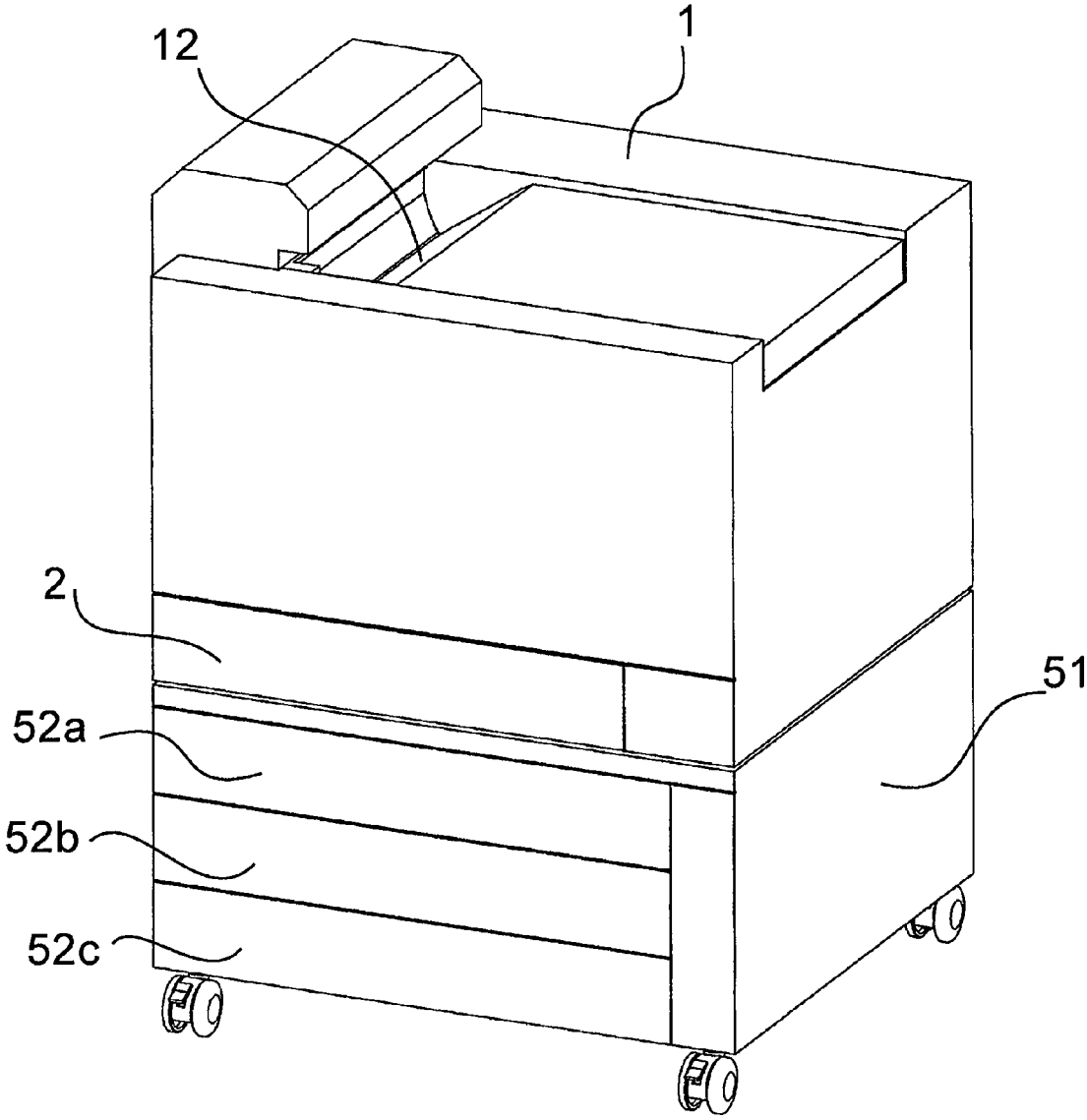
FIG. 2 is a schematic perspective view illustrating the entire printer to which the sheet feeding apparatus is attached.
Figure 3:
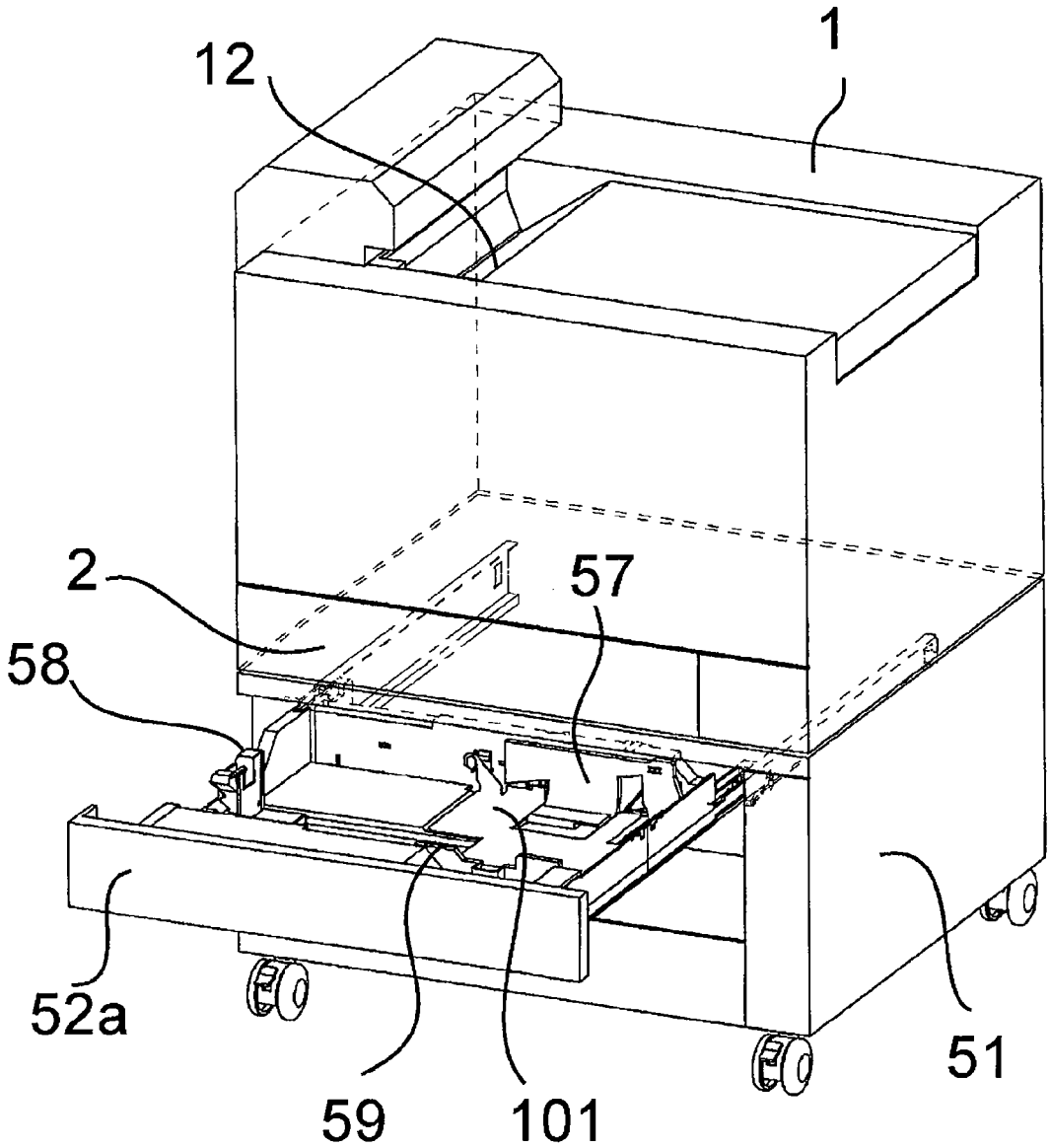
FIG. 3 is a schematic perspective view when a sheet cassette in the sheet feeding apparatus is pulled out.

The entire structure of the image forming apparatus will be explained together with an image forming operation with reference to FIGS. 1 to 3. FIG. 1 is a schematic sectional view illustrating the entire structure of the image forming apparatus to which the sheet feeding apparatus is attached. FIG. 2 is a perspective view of the entire image forming apparatus. FIG. 3 is a diagram illustrating the entire state where the sheet cassette of the image forming apparatus is pulled out.

In FIG. 1, the image forming apparatus body 1 has a sheet cassette 2 in which sheets Sa are stacked and stored, and the sheet cassette 2 is attached into the image forming apparatus. A pickup roller 3 sends out sheets S stacked in the sheet cassette 2 from the top sheet. A pair of retard rollers 4 convey the sent out sheets S one-sheet by one-sheet separately, and the sheets S are conveyed to an image forming portion by conveying rollers 5 and 6.

A known process member concerning image formation is incorporated in a process cartridge 7, and the process cartridge 7 is detachably attached to the apparatus body. A photosensitive drum 7*a* as an image bearing member is incorporated in the process cartridge. The photosensitive drum 7*a* is irradiated with laser light in accordance with image information by a laser exposure apparatus 8, an image is written, and a toner image is formed.

A transfer roller 9 is pressed on the photosensitive drum 7*a*, and a toner image on the drum surface is transferred to a sheet S when the sheet S passes between the photosensitive drum 7*a* and the transfer roller 9. A fixing apparatus 10 fixes (fuses) the transferred images by applying heat and pressure to the sheet S after the image was transferred to the sheet S. The sheet S after the images was fixed (fused) is conveyed and discharged into a discharge tray 12 formed on an upper surface of the apparatus by a pair of discharge rollers 11 such that a surface of the sheet S on which the images was formed points downward.

[Sheet Feeding Apparatus]

Next, the sheet feeding apparatus will be explained. A sheet feeding apparatus 51 of the embodiment is constituted as a three-cassette deck. The sheet feeding apparatus 51 also functions as a mounting stage of the image forming apparatus body 1, and the sheet feeding apparatus 51 is disposed on a lower portion of the image forming apparatus. Casters are mounted on four locations of a lower surface of the sheet feeding apparatus 51 so that the sheet feeding apparatus 51 can move in a state where the image forming apparatus body 1 is placed thereon.

The sheet feeding apparatus 51 has three sheet feeding members and sheet cassettes 52*a*, 52*b* and 52*c*. Each sheet cassette is constituted such that sheets of various sizes and weights can be stacked. If the sheet feeding apparatus receives a sheet-feed signal from the image forming apparatus body, the sheet feeding apparatus selects a sheet cassette on which sheets suitable for the sheet-feed signal are stacked, and the sheet feeding apparatus can feed the sheets S to the image forming apparatus body 1 from the sheet cassette one-sheet at a time.

Here, the sheet feeding members and the sheet cassettes provided in the sheet feeding apparatus 51 will be explained. Since the three sheet feeding members and the sheet cassettes 52*a*, 52*b* and 52*c* have the same structure, the top sheet feeding member and the top sheet cassette will be explained. Unless it is necessary to distinguish them from one another, added alphabets a, b and c added to the drawings for expressing elements of the sheet feeding members and the sheet cassettes will be omitted from the description.

As shown in FIGS. 1 and 3, the sheet feeding apparatus 51 is provided with a vertically movable sheet cassette, which includes a sheet storage portion in which sheets S are stored. The sheet feeding apparatus includes a sheet storage portion having a middle plate 101 which is the sheet stacking member on which sheets are stacked and restriction plates 57, 58 and 59, and a sheet-feed roller 53 which is a sheet feeding member for sending out a top sheet S1 of the sheets S stacked on the middle plate 101. The sheet feeding apparatus 51 further includes a pair of separation rollers 54 and 55 comprising a feed roller 54 and a retard roller 55 which separate sheets S sent out by the sheet-feed roller 53. The sheet feeding apparatus 51 further includes a conveying roller 56 which conveys, to the image forming apparatus body, the sheets S which are separately fed one-sheet at a time by the pair of separation rollers 54 and 55.

Figure 5:
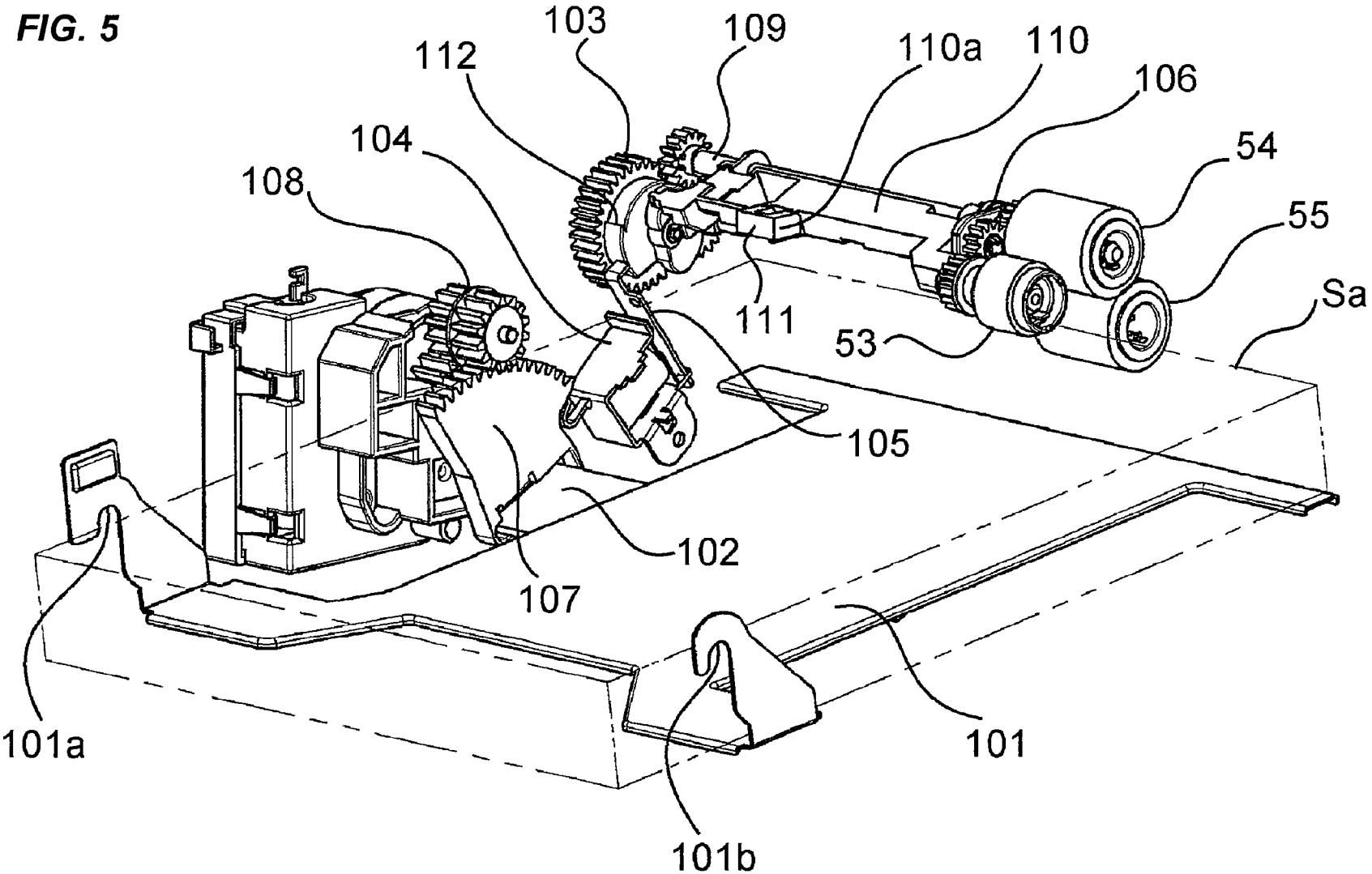
FIG. 5 is a schematic perspective view illustrating a state where a middle plate rises.
Figure 6:
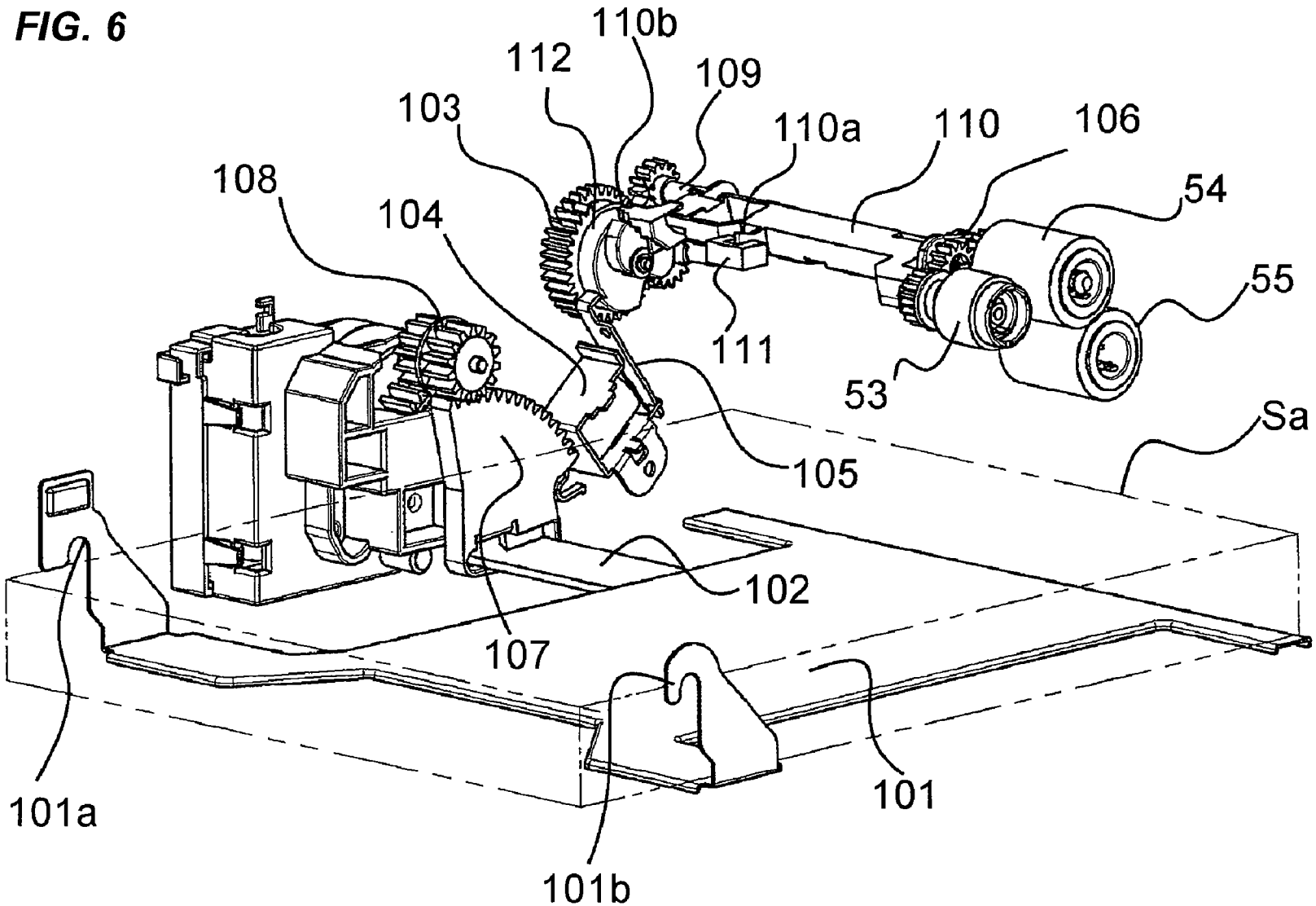
FIG. 6 is a schematic perspective view illustrating a state where the sheet cassette is inserted.

The detailed structure of the sheet feeding portion of the embodiment will now be described. FIGS. 4 to 6 are diagrams for explaining the structure of the sheet feeding apparatus sheet feeding portion.

In the drawings, a snaggletooth gear 103 rotates the feed roller 54, and a flapper member 105 is operated by a solenoid 104. The feed roller 54 is rotated several times by one rotation control of the snaggletooth gear 103 by the flapper member 105. Rotation of the feed roller 54 is transmitted to the sheet-feed roller 53 through a planet gear 106.

The middle plate 101 supports the stacked sheets. The middle plate 101 is provided on a sheet cassette 52 such that the middle plate 101 can turn (move) around retaining portions 101*a* and 101*b* shown in FIG. 5. A sector gear 107 is provided on one end of a push-up plate 102 provided below the middle plate 101. The sector gear 107 includes a gear portion which meshes with a pinion 108 which is rotated by a lift motor (not shown) provided in the apparatus body. The sector gear 107 is rotated by rotation of the pinion 108, the middle plate 101 is turned by the push-up plate 102, thereby moving sheets upwards towards the sheet-feed roller (53). The pinion 108, the sector gear 107 and the push-up plate 102 constitute a lifter mechanism of the embodiment.

A lift motor (not shown) is driven and controlled by a control section. The control section rotates the pinion 108 using the lift motor based on a detection signal from a later-described position detection sensor, and moves the middle plate 101 toward the sheet-feed roller 53 through a gear portion and the push-up plate. With this, one end of the middle plate 101 is lifted to provide a given height at which an appropriate pressure is applied between an upper surface of a sheet supported when the sheet is fed and the sheet-feed roller 53.

The sheet-feed roller 53 is rotatably held by a roller holder 110 which is turnably mounted on a shaft 109 of the feed roller 54 shown in FIG. 5, and the sheet-feed roller 53 can move relative to the feed roller 54. The roller holder 110 is provided with a sensor flag 110*a*. When the sheet-feed roller 53 is located at an initial position (standby position) shown in FIG. 6, light from the position detection sensor 111 is blocked by the sensor flag 110*a*. The roller holder 110, the sensor flag 110*a* and the position detection sensor 111 constitute a detector which outputs a detection signal based on a position of the sheet-feed roller 53. The position detection sensor 111 is a photo-sensor, and if the light from the position detection sensor 111 is blocked by the sensor flag 110*a*, the position detection sensor 111 sends an ON signal, and if the light is not blocked, the position detection sensor 111 sends an OFF signal.

A cam member 112 engages the snaggletooth gear 103 and rotate in unison when the snaggletooth gear 103 rotates. An abutting portion 110*b* (see FIG. 6) which abuts against the cam member 112 is provided at a turning end of the roller holder 110.

If the abutting portion 110*b* abuts against a cam member 112 by its own weight or via a biasing member such as a spring (not shown), and one rotation control of the snaggletooth gear 103 is carried out, the sheet-feed roller 53 drops (rotates) due to the shape of the cam member and moves to a position where the sheet-feed roller 53 abuts against a sheet S. Then, the sheet-feed roller 53 retracts from the sheet halfway through the sending motion of the sheet, and returns to the initial position (first position) shown in FIG. 6.

If the sheets S are fed one-sheet at a time by such a control, the number of sheets Sa stacked on the middle plate 101 is reduced and the height of the upper surface of the sheets is reduced. With this, the sheet-feed roller 53 is lowered together with the roller holder 110, block of light of the position detection sensor 111 by the sensor flag 110*a* is released by the lowering of the roller holder 110 as shown in FIG. 4C, and a non-detection state (OFF state) is established.

If the roller holder 110 lowers to the position where the blocking of light from the position detection sensor 111 ceases, i.e., the position where the position detection sensor 111 is brought into the non-detection state, the appropriate sheet feeding pressure can not be applied to the upper surface of the sheet S by the sheet-feed roller 53. Therefore, if the position detection sensor 111 is brought into the non-detection state, the control section drives the lift motor and again moves up one end of the middle plate 101 to a position (second position) using the push-up plate 102 of the lifter mechanism where the appropriate pressure is applied when a sheet is fed and an upper surface of the sheet Sa reaches a substantially constant height. Here, the second position is a position where the sheet-feed roller 53 is lowered to the position shown in FIG. 4C, the middle plate 101 rises from a state where the position detection sensor 111 is OFF, the sheet-feed roller 53 is pushed up and the position detection sensor 111 is switched from OFF to ON. When the sheet-feed roller 53 is in the second position shown in FIG. 4B, the appropriate pressure is applied to a sheet and the sheet is reliably fed.

If the position detection sensor 111 is brought into the non-detection state while sheets are sequentially fed in a state where the position of the roller holder 110 (sheet-feed roller 53) is detected by the position detection sensor 111, the middle plate 101 is moved by the lifter mechanism. Sheets can reliably fed until the last sheet is fed by repeating the control such that the upper surface position of a sheet comes to a predetermined position. Although the control is performed such that the sheet-feed roller 53 moves from the sheet feeding position to the standby position whenever one sheet is sent in this embodiment, if sheets are continuously fed, the sheet-feed roller 53 may be maintained in the sheet feeding position of sheets. In this case, after the last one of sheets to be fed continuously is fed, the sheet-feed roller 53 is moved to the standby position.

[Control after Sheet Cassette is Inserted]

Next, control when sheets are set in the sheet cassette 52 of the sheet feeding apparatus of the embodiment will be described.

Figure 7:
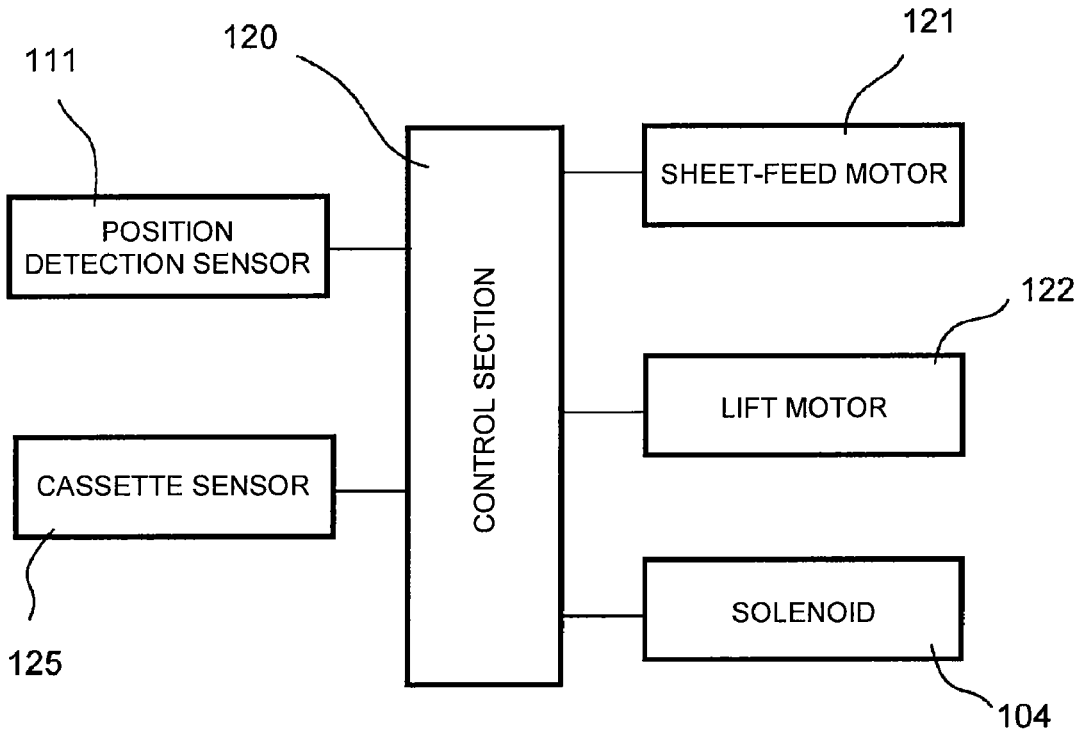
FIG. 7 is a block diagram of a control section which executes a control mode when the sheet cassette is inserted.
Figure 8:
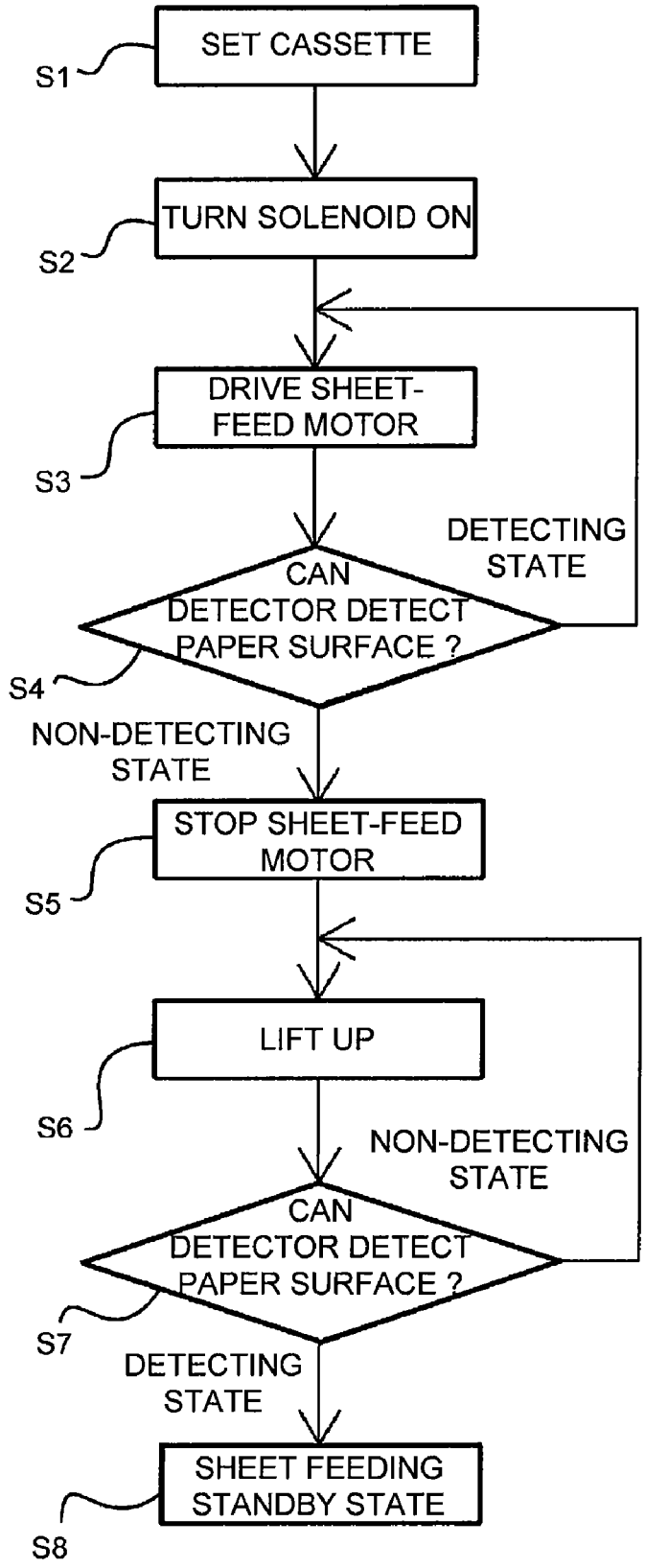
FIG. 8 is a flowchart illustrating control procedure when the sheet cassette is inserted.
Figure 9A:
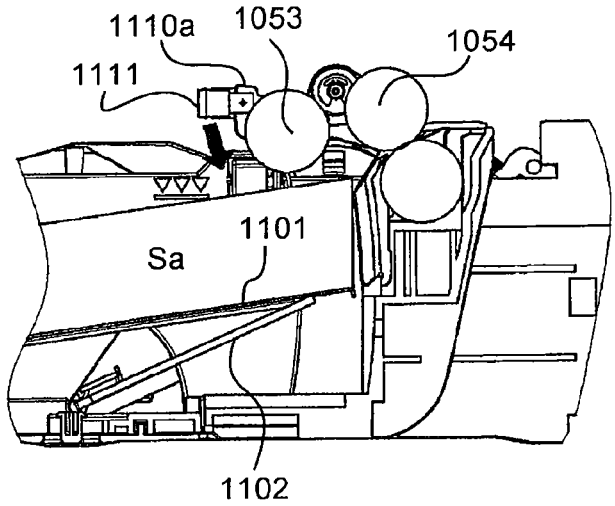
FIG. 9A PRIOR ART
FIGS. 9A to 9C are schematic sectional views illustrating internal structures of a sheet feeding member and a sheet cassette of a conventional example.
Figure 9B:
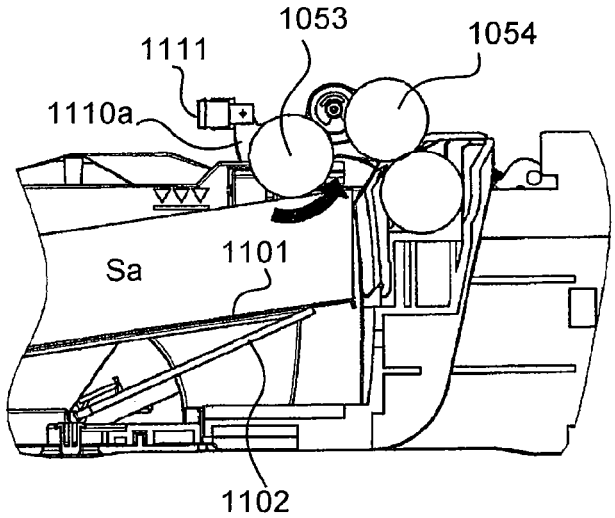
FIG. 9B PRIOR ART
Figure 9C:
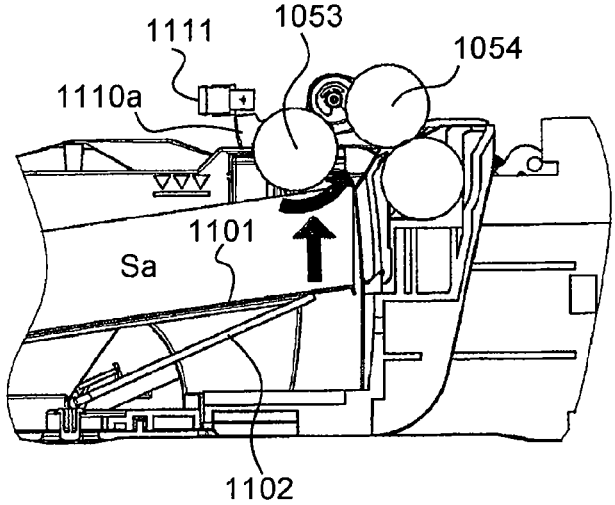
FIG. 9C PRIOR ART
Figure 10:
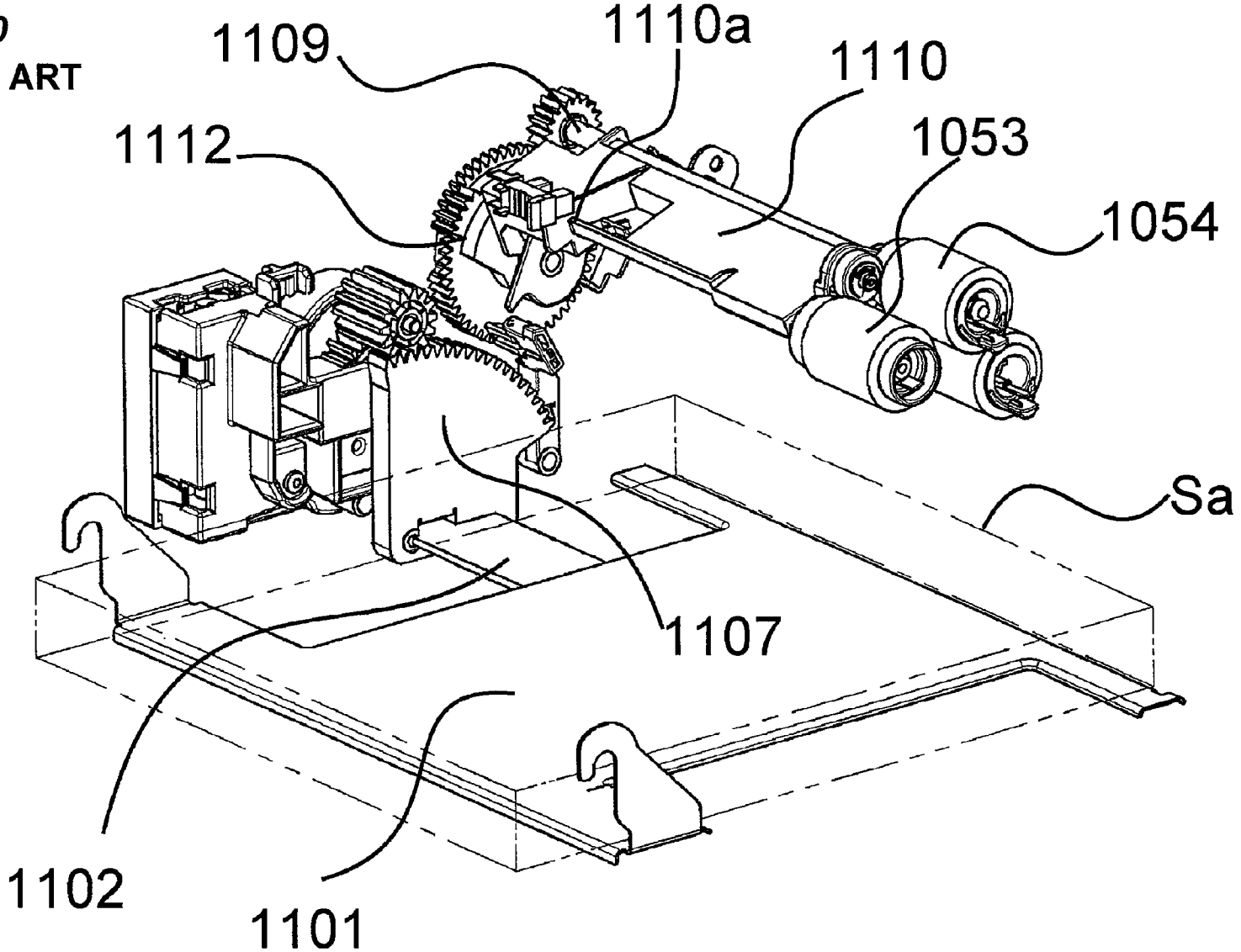
FIG. 10 PRIOR ART
FIG. 10 is a schematic perspective view illustrating a state of the conventional example where the sheet cassette is inserted.
Figure 11A:
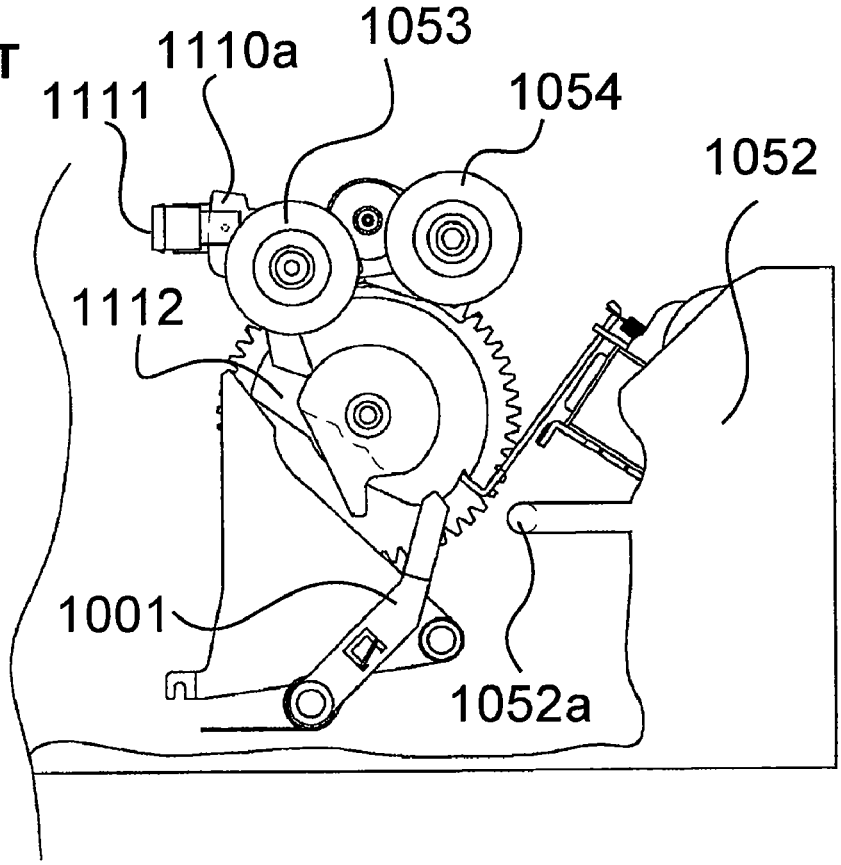
FIG. 11A PRIOR ART
FIGS. 11A and 11B are schematic sectional views illustrating a cam mechanism in the conventional example.
Figure 11B:
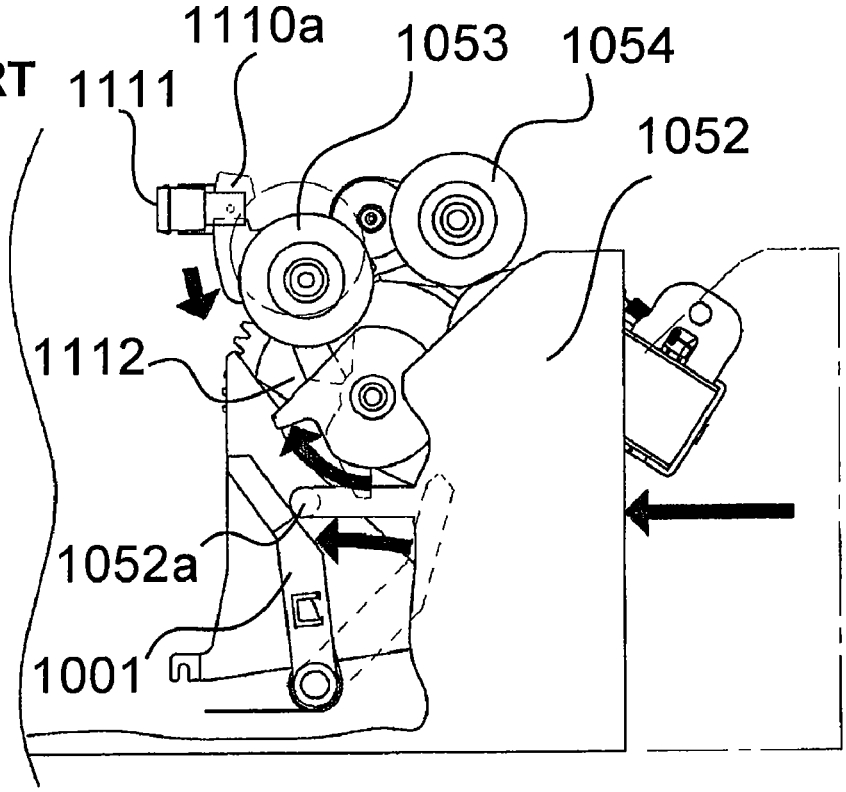
FIG. 11B PRIOR ART

The sheet feeding apparatus of the embodiment has a position control mode for controlling the height of the top sheet after sheets are set in the sheet cassette 52 and the sheet cassette 52 is inserted. The position control mode is driven and controlled by a control section as shown in FIG. 7. The control section 120 receives a signal from the position detection sensor 111 which detects the position of the sheet-feed roller 53, and a signal from a cassette sensor 125 which detects the setting of the sheet cassette 52. The control section 120 drives and controls the solenoid 104, a sheet-feed motor 121 which drives the sheet-feed roller 53, and the lift motor 122 which operates the push-up plate 102, by signals from the sensors. With this, control is performed such that procedure shown in the flowchart in FIG. 8 is executed when the first sheet feeding operation is performed after the sheet cassette is inserted. The operation of the position control mode will now be described.

If the sheet cassette 52 is pulled out from the sheet feeding apparatus as shown in FIG. 3, connection with respect to a lifter drive apparatus provided in the sheet feeding apparatus 51 is released and with this, the middle plate 101 is lowered to the lowermost position by its own weight as shown in FIG. 3. After sheets are added onto the middle plate 101, if the sheet cassette 52 is inserted and set into the sheet feeding apparatus 51, the top one of the sheets stacked on the middle plate 101 is located below the sheet feeding position.

Since the sheet-feed roller 53 is at the initial position (first position) in the state shown in FIG. 6 when the sheet cassette is inserted, the position detection sensor 111 is in a detection state (ON state) at that time. That is, the substantially constant height at which an appropriate pressure is applied by the sheet-feed roller 53 is not detected. In this embodiment, a state from the instant when the sheet cassette 52 is pulled out to the instant when the sheet cassette 52 is attached is defined as a sheet feeding standby state.

In this embodiment, the flapper member 105 is operated by the solenoid 104 at that time, the snaggletooth gear 103 is rotated a given angle by the sheet-feed motor 121, and the position detection sensor 111 is brought into the non-detection state. In this state, a sheet on the middle plate 101 is moved toward the sheet-feed roller 53 by driving the lift motor 122 of the lifter mechanism, and if the position detection sensor 111 detects the detection state, the driving of the lift motor of the lifter mechanism is stopped.

More specifically, as shown in the flowchart in FIG. 8, if the sheet cassette is inserted and set into the sheet feeding apparatus after the sheet cassette is pulled out and sheets are added, this is detected by the cassette sensor 125 (S1). The control section 120 which received this detection signal operates the solenoid 104, rotates the sheet-feed motor 121 by a given amount and stops the motor.

Figure 4A:
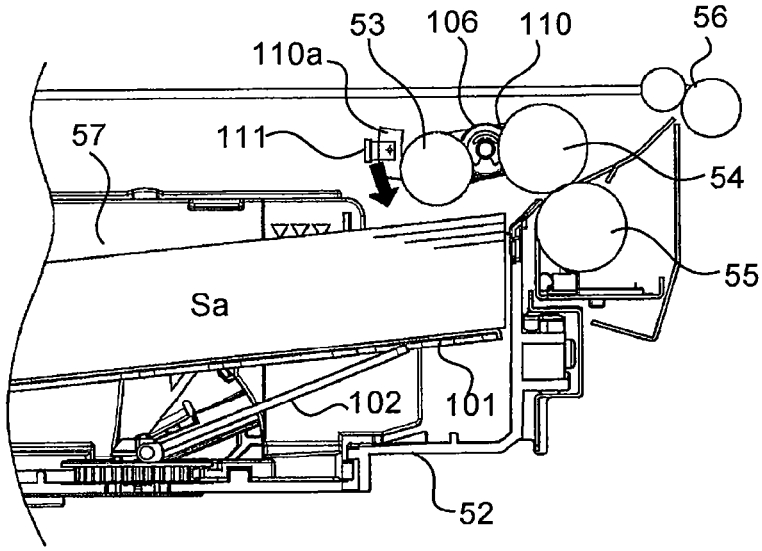
FIGS. 4A to 4C are schematic sectional views illustrating internal structures of a sheet feeding means and the sheet cassette.
Figure 4B:
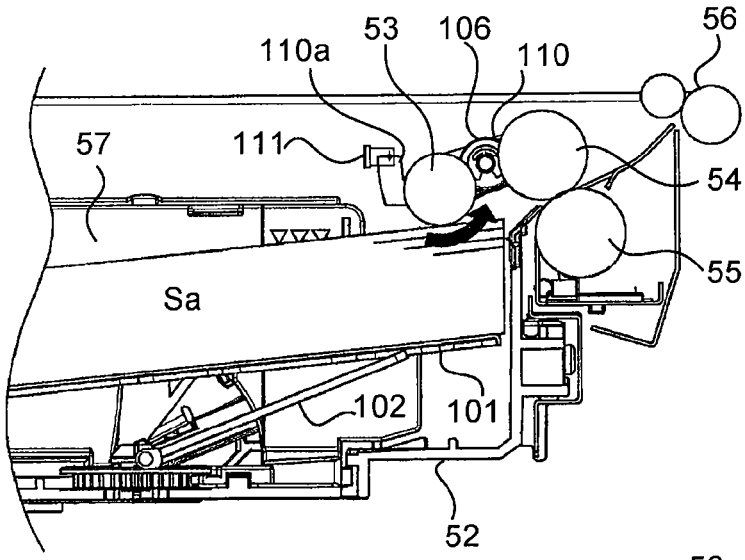
Figure 4C:
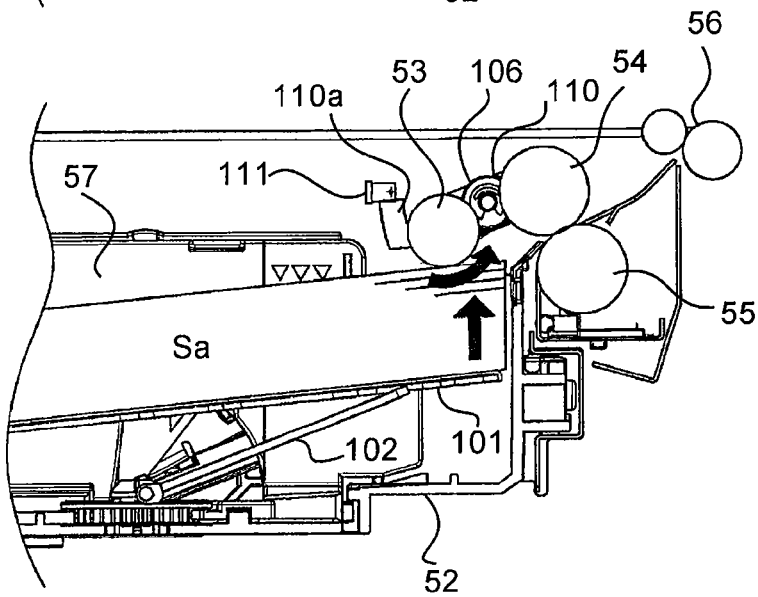

That is, as shown in FIG. 4A, the sheet-feed roller 53 is lowered from the position where the sheet-feed roller 53 is in the initial position and the sensor flag 110*a* blocks the light of the position detection sensor 111 and is in the detection state (ON state). Then, as shown in FIG. 4C, the sheet-feed roller 53 is lowered to a predetermined position (third position) where the sensor flag 110*a* releases the block of light of the position detection sensor 111 and the non-detection state (OFF state) is established and the sheet-feed roller 53 is stopped (S3 to S5). In the third position, the position of the sheet-feed roller 53 is lower than that in the second position, and the position detection sensor 111 is reliably brought into the non-detection state.

Next, the lift motor 122 of the lifter mechanism is driven and the middle plate 101 is pushed up by the push-up plate 102 (S6). With this, a surface of the top one of the sheets Sa stacked on the middle plate 101 abuts against the sheet-feed roller 53 and rises. The position detection sensor 111 is brought into detection state (ON state) and if it is detected that the sheet-feed roller 53 is in the second position, the driving of the lift motor 122 is stopped and is brought into the sheet feeding standby state (S7 and S8).

With this, the middle plate 101 can rise to the substantially constant height position where the appropriate pressure is applied between the sheet-feed roller 53 and an upper surface of a sheet which is supported when the sheet is fed.

With this, the height of the top sheet on the middle plate 101 can fall within the predetermined range without providing any special mechanism, and a sheet can be moved to the sheet-feeding position with a simple structure without increasing the cost.

In the above embodiment, the position control mode in which the insertion of the sheet cassette is detected by the cassette sensor and the movements of the sheet-feed roller 53 and the middle plate are controlled is executed. However, when the sheet cassette is inserted, the position control may not be carried out, and when a sheet-feed signal is sent thereafter and the first sheet feeding operation is carried out, the position control mode may be carried out. That is, the control of the present invention may be carried out when the first sheet-feed signal is input in the sheet feeding-standby state.

The sheet feeding apparatus of the present invention for achieving the above object has the following elements.

A sheet stacking member on which a sheet is stacked, a lifter mechanism which vertically moves the sheet stacking member, a sheet feeding member which can vertically move, and which abuts against the sheet stacked on the sheet stacking member to feed the sheet, and a detector which outputs a detection signal based on a position of the sheet feeding member. The sheet stacking member is vertically moved by the lifter mechanism based on detection of the detector, an upper surface of the stacked sheet is moved to a sheet-feeding position by the sheet feeding member. The sheet feeding member is positioned on a standby position above the sheet feeding position in a sheet feeding standby state. When the sheet feeding operation of the sheet is started from the sheet feeding standby state, the sheet feeding member is lowered from the standby position, the sheet stacking member is lifted by the lifter mechanism based on detection of the detector, and the upper surface of the sheet stacked on the sheet stacking member is moved to the sheet-feeding position.

A sheet feeding apparatus which feeds a sheet stacked on a sheet stacking member by a sheet feeding member has the following elements.

A sheet stacking member on which a sheet is stacked, a lifter mechanism which vertically moves the sheet stacking member, a sheet feeding member which feeds a sheet stacked on the sheet stacking member, and which can move to a first position retracted from the sheet stacked on the sheet stacking member, a second position lower than the first position for feeding the sheet, and a third position lower than the second position, and detector which detects a position of the sheet feeding member. The sheet feeding apparatus has a position control mode in which when a sheet is fed, the sheet feeding member is moved from the first position to the third position and stopped there, the sheet stacking member is moved toward the sheet feeding member by the lifter mechanism, the sheet stacked on the sheet stacking member is brought into abutment against the sheet feeding member, the sheet stacking member is moved until the detector detects that the sheet feeding member is in the second position, and a height of the sheet is controlled.

According to the present invention, when the sheet stacking member is accommodated in the apparatus body and a sheet is fed, the sheet feeding member is lowered from a sheet feeding position and then, the sheet stacking member is moved and the height of the sheet is controlled. With this, the height of the top sheet on the sheet stacking member can be located within a predetermined range without providing any special mechanism, and a sheet can be moved to a sheet-feeding position with a simple structure without increasing the cost.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structure and functions.

This application claims the benefit of Japanese Patent Application No. 2007-232260, filed Sep. 7, 2007, which is hereby incorporated by reference herein in its entirety.

What is claimed is:

1. A sheet feeding apparatus comprising a sheet stacking member configured to stack sheets, a sheet feeding member which is moveable between a standby position in a sheet feeding standby state and a sheet feeding position below the standby position, and which is configured to engage with an upper surface of a topmost sheet of the sheets stacked on the sheet stacking member to feed the sheet at the sheet feeding position, and in a middle of a sheet feeding operation of the sheet feeding member, the sheet feeding member is returned to the standby position, a sheet feed motor configured to drive the sheet feed member to feed the sheet, a moving mechanism configured to move the sheet feeding member between the standby position and the sheet feeding position by a drive of the sheet feed motor, a position detector, operable to output a detection signal based on a position of the sheet feeding member, and a lifter mechanism which is configured to lift the sheet stacking member towards the sheet feeding member, the lifter mechanism lifts, the sheet stacking member based on detection of the position detector, such that the upper surface of the topmost sheet is moved to the sheet-feeding position, wherein when a first sheet feeding operation of the sheet feeding member starts after sheets are set on the sheet stacking member in a lower position, the sheet feed motor rotates by a predetermined amount and stops so that the sheet feeding member is lowered from the standby position towards the sheet feeding position by the moving mechanism in a state that the sheet stacking member is in the lower position, and wherein when the sheet feeding member is lowered from the standby position towards the sheet feeding position in the first sheet feeding operation, the sheet stacking member is lifted by the lifter mechanism based on detection of the position detector so that the upper surface of the sheet stacked on the sheet stacking member is moved to the sheet-feeding position.

2. A sheet feeding apparatus according to claim 1, wherein a sheet feeding member is operable to move to a first position retracted from the sheet stacked on the sheet stacking member, a second position lower than the first position for feeding the sheet, and a third position lower than the second position, and the sheet feeding apparatus has a position control mode in which when a sheet is fed, the sheet feeding member is moved from the first position to the third position and stopped there, the sheet stacking member is moved by the lifter mechanism toward the sheet feeding member, the sheet stacked on the sheet stacking member is brought into engagement with the sheet feeding member, and the sheet stacking member is moved until the position detector outputs the detection signal that the sheet feeding member is in the second position.

3. The sheet feeding apparatus according to claim 2, wherein the position detector switches between an ON signal and an OFF signal when the sheet feeding member arrives at the second position.

4. The sheet feeding apparatus according to claim 2, wherein the position control mode is executed when the first sheet feeding operation after a sheet is set on the sheet stacking member is carried out.

5. An image forming apparatus which feeds a sheet and forms an image, comprising a sheet feeding apparatus comprising a sheet stacking member configured to stack sheets, a sheet feeding member which is moveable between a standby position in a sheet feeding standby state and a sheet feeding position below the standby position, and which is configured to engage with an upper surface of a topmost sheet of the sheets stacked on the sheet stacking member to feed the sheet at the feeding position, and in a middle of a sheet feeding operation of the sheet feeding member, the sheet feeding member is returned to the standby position, a sheet feed motor configured to drive the sheet feed member to feed the sheet, a moving mechanism configured to move the sheet feeding member between the standby position and the sheet feeding position by a drive of the sheet feed motor, a position detector, operable to output a detection signal based on a position of the sheet feeding member, and a lifter mechanism which is configured to lift the sheet stacking member towards the sheet feeding member, the lifter mechanism lifts the sheet stacking member based on detection of the position detector, such that an the upper surface of the topmost stacked sheet is moved to a sheet-feeding position, wherein when a first sheet feeding operation of the sheet feeding member starts after sheets are set on the sheet stacking member in a lower position, the sheet feed motor rotates by a predetermined amount and stops so that the sheet feeding member is lowered from the standby position towards the sheet feeding position by the moving mechanism in a state that the sheet stacking member is in the lower position, and wherein when the sheet feeding member is lowered from the standby position towards the sheet feeding position in the first sheet feeding operation, the sheet stacking member is lifted by the lifter mechanism based on detection of the position detector so that the upper surface of the sheet stacked on the sheet stacking member is moved to the sheet-feeding position, and an image forming portion which forms an image on a fed sheet.

6. The image forming apparatus according to claim 5, wherein a sheet feeding member is operable to move to a first position retracted from the sheet stacked on the sheet stacking member, a second position lower than the first position for feeding the sheet, and a third position lower than the second position, and the sheet feeding apparatus has a position control mode in which when a sheet is fed, the sheet feeding member is moved from the first position to the third position and stopped there, the sheet stacking member is moved by the lifter mechanism toward the sheet feeding member, the sheet stacked on the sheet stacking member is brought into engagement with the sheet feeding member, and the sheet stacking member is moved until the position detector outputs the detection signal that the sheet feeding member is in the second position.

7. The image forming apparatus according to claim 6, wherein the position detector switches between an ON signal and an OFF signal when the sheet feeding member arrives at the second position.

8. The image forming apparatus according to claim 6, wherein the position control mode is executed when the first sheet feeding operation after a sheet is set on the sheet stacking member is carried out.

9. A sheet feeding apparatus comprising a sheet cassette which is pulled out from and to be attached to a body of the apparatus;

a sheet stacking member, provided on the sheet cassette, configured to stack sheets, a sheet feeding member which is moveable between a standby position in a sheet feeding standby state and a sheet feeding position below the standby position, and which is configured to engage with an upper surface of a topmost sheet of the sheets stacked on the sheet stacking member to feed the sheet at the sheet feeding position, and in a middle of the sheet feeding operation of the sheet feeding member, the sheet feeding member is returned to the standby position, a sheet feed motor configured to drive the sheet feed member to feed the sheet, a moving mechanism configured to move the sheet feeding member between the standby position and the sheet feeding position by a drive of the sheet feed motor, a position detector, operable to output a detection signal based on a position of the sheet feeding member, a cassette detector operable to output a detection signal based on an attachment of the sheet cassette to the body of the apparatus, and a lifter mechanism which is configured to lift the sheet stacking member towards the sheet feeding member, the lifter mechanism lifts the sheet stacking member based on detection of the position detector, such that the upper surface of the topmost sheet is moved to the sheet feeding position, wherein when the cassette detector outputs the detection signal based on an attachment of the sheet cassette to the body of the apparatus, the sheet feed motor rotates by a predetermined amount and stops so that the sheet feeding member is lowered from the standby position towards the sheet feeding position by the moving mechanism in a state that the sheet stacking member is in the lower position, and wherein when the sheet feeding member is lowered from the standby position towards the sheet feeding position in the first sheet feeding operation, the sheet stacking member is lifted by the lifter mechanism based on detection of the position detector so that the upper surface of the sheet stacked on the sheet stacking member is moved to the sheet feeding position.

10. A sheet feeding apparatus according to claim 9, wherein a sheet feeding member is operable to move to a first position retracted from the sheet stacked on the sheet stacking member, a second position lower than the first position for feeding the sheet, and a third position lower than the second position, and the sheet feeding apparatus has a position control mode in which when a sheet is fed, the sheet feeding member is moved from the first position to the third position and stopped there, the sheet stacking member is moved by the lifter mechanism toward the sheet feeding member, the sheet stacked on the sheet stacking member is brought into engagement with the sheet feeding member, and the sheet stacking member is moved until the position detector outputs the detection signal that the sheet feeding member is in the second position.

11. The sheet feeding apparatus according to claim 10, wherein the position detector switches between an ON signal and an OFF signal when the sheet feeding member arrives at the second position.

12. The sheet feeding apparatus according to claim 10, wherein the position control mode is executed when the first sheet feeding operation after a sheet is set on the sheet stacking member is carried out.

13. An image forming apparatus which feeds a sheet and forms an image, comprising a sheet feeding apparatus comprising a sheet cassette which is pulled out from and to be attached to a body of the apparatus;

a sheet stacking member, provided on the sheet cassette, configured to stack sheets, a sheet feeding member which is moveable between a standby position in a sheet feeding standby state and a sheet feeding position below the standby position, and which is configured to engage with an upper surface of a topmost sheet of the sheets stacked on the sheet stacking member to feed the sheet at the feeding position, and in a middle of the sheet feeding operation of the sheet feeding member, the sheet feeding member is returned to the standby position, a sheet feed motor configured to drive the sheet feed member to feed the sheet, a moving mechanism configured to move the sheet feeding member between the standby position and the sheet feeding position by a drive of the sheet feed motor, a position detector, operable to output a detection signal based on a position of the sheet feeding member, a cassette detector operable to output a detection signal based on an attachment of the sheet cassette to the body of the apparatus, and a lifter mechanism which is configured to lift the sheet stacking member towards the sheet feeding member, the lifter mechanism lifts the sheet stacking member based on detection of the position detector, such that the upper surface of the topmost stacked sheet is moved to a sheet feeding position, wherein when the cassette detector outputs the detection signal based on an attachment of the sheet cassette to the body of the apparatus, the sheet feed motor rotates by a predetermined amount and stops so that the sheet feeding member is lowered from the standby position towards the sheet feeding position by the moving mechanism in a state that the sheet stacking member is in the lower position, and wherein when the sheet feeding member is lowered from the standby position towards the sheet feeding position in the first sheet feeding operation, the sheet stacking member is lifted by the lifter mechanism based on detection of the position detector so that the upper surface of the sheet stacked on the sheet stacking member is moved to the sheet feeding position, and an image forming portion which forms an image on a fed sheet.

14. The image forming apparatus according to claim 13, wherein a sheet feeding member is operable to move to a first position retracted from the sheet stacked on the sheet stacking member, a second position lower than the first position for feeding the sheet, and a third position lower than the second position, and the sheet feeding apparatus has a position control mode in which when a sheet is fed, the sheet feeding member is moved from the first position to the third position and stopped there, the sheet stacking member is moved by the lifter mechanism toward the sheet feeding member, the sheet stacked on the sheet stacking member is brought into engagement with the sheet feeding member, and the sheet stacking member is moved until the position detector outputs the detection signal that the sheet feeding member is in the second position.

15. The image forming apparatus according to claim 14, wherein the position detector switches between an ON signal and an OFF signal when the sheet feeding member arrives at the second position.

16. The image forming apparatus according to claim 14, wherein the position control mode is executed when the first sheet feeding operation after a sheet is set on the sheet stacking member is carried out.

* * * * *